US005572793A

United States Patent [19]

Collins et al.

[11] Patent Number: 5,572,793

[45] Date of Patent: Nov. 12, 1996

[54] LOCKING KNIFE AND SHEATH

[76] Inventors: Walter W. Collins, P.O. Box 100, North, S.C. 29112; Spencer Frazier, P.O. Box 1024, Edmonds, Wash. 98020

[21] Appl. No.: 219,508

[22] Filed: Mar. 29, 1994

Related U.S. Application Data

[63] Continuation-in-part of Ser. No. 7,609, Jan. 22, 1993, Pat. No. 5,297,341.

[51] Int. Cl.[6] ..... B26B 1/02

[52] U.S. Cl. ..... 30/157; 30/155

[58] Field of Search ..... 30/162, 151, 159, 30/157, 158, 160, 161, 155; 224/232, 252; 24/3.11, 3.12, 3.1

[56] References Cited

U.S. PATENT DOCUMENTS

| | | | |
|---|---|---|---|
| 3,103,723 | 9/1963 | Becker | 24/3.12 |
| 3,246,813 | 4/1966 | Miller | 30/162 |
| 3,381,807 | 5/1968 | De Vaughn | 30/162 |
| 5,025,557 | 6/1991 | Perreault | 30/162 |
| 5,123,167 | 6/1992 | Kelley | 30/162 |
| 5,138,768 | 8/1992 | Collins | 30/162 |
| 5,155,911 | 10/1992 | Collins | 30/162 |
| 5,255,436 | 10/1993 | Yoshida | 224/232 |

*Primary Examiner*—Rinaldi I. Rada
*Assistant Examiner*—Allan M. Schrock
*Attorney, Agent, or Firm*—Leatherwood Walker Todd & Mann

[57] ABSTRACT

A locking knife and sheath combination having a knife of unitary construction. A flexible engagement tab is provided on the handle of the knife for engaging with a tab receiving opening provided in a front portion of the sheath. Upon engagement of the tab with such opening, the knife is securely retained in the sheath. Removal of the knife from the sheath is accomplished by depression of the tab through the tab opening of the sheath. Sheath clamping means are also provided on the opposite side of the sheath and include a clamping arm which pivots with respect to the rearward surface of the sheath through means of rotation of a thumbwheel adjustment member. Rotation of the adjustment member allows for the clamping arm to selectively clamp the sheath to an article. A clamping device is provided for a folding knife having a thumbwheel adjustment member.

18 Claims, 6 Drawing Sheets

Fig. 3
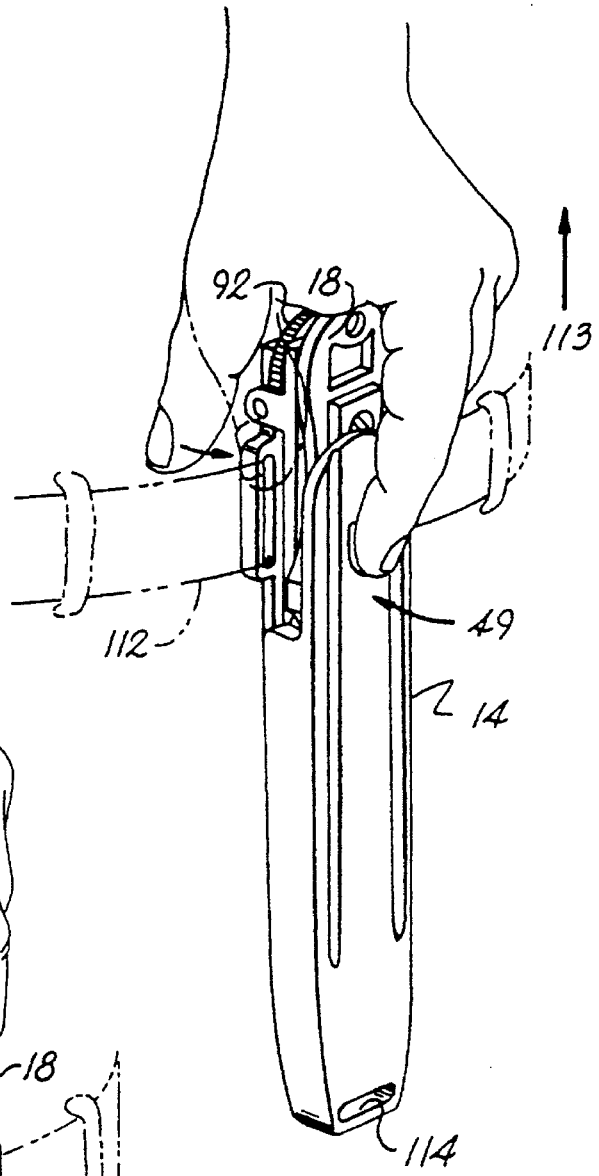
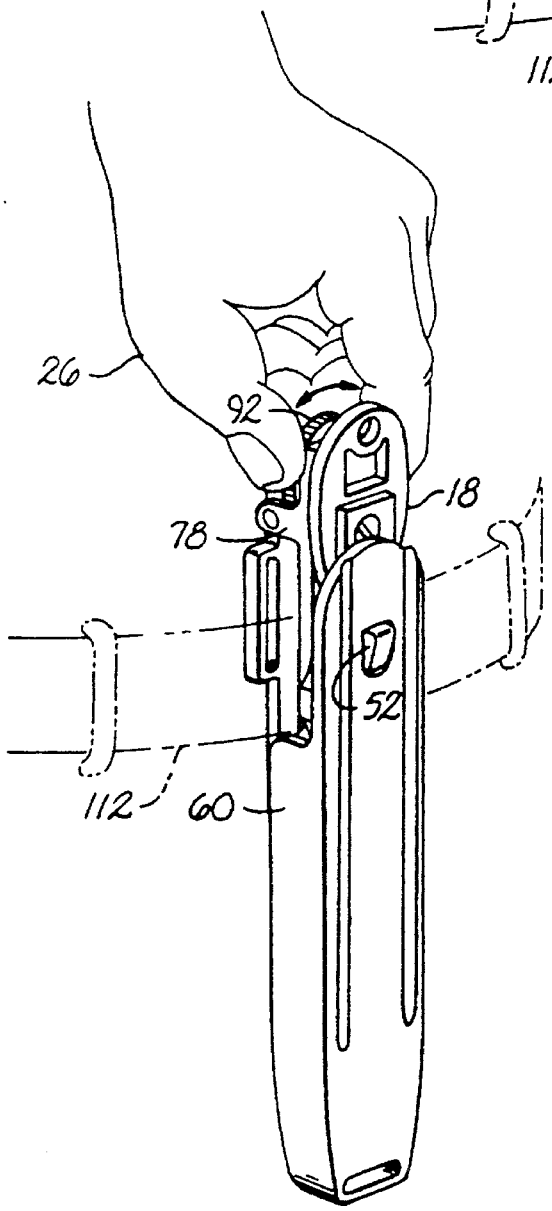
Fig. 4

LOCKING KNIFE AND SHEATH

This application is a continuation-in-part of application Ser. No. 08/007,609, filed Jan. 22, 1993, now U.S. Pat. No. 5,297,341.

BACKGROUND OF THE INVENTION

This invention relates generally to a locking knife and sheath combination which is readily attachable to a garment, belt, boot, or the like.

The typical knife includes a metal blade with a handle made from plastic, wood, metal, laminate, or the like, being fixed to the blade in some manner. The handle portion can be molded directly onto a shank, or tang, portion extending from the blade or can be attached to such tang portion by rivets, screws, or some other suitable fasteners. In the manufacturing context, the attachment of a handle to the knife usually requires additional manufacturing steps, which accordingly increases the complexity of manufacture and labor costs in general.

All-metal knives, where the blade and handle are both provided on a unitary piece of metal, have been produced. Because of the relative ease of manufacture, they can be produced quite economically, in that no separate handle assembly is required. Also, since the separate handle, which could break, become loose, or fall off, is not required, such all-metal knives tend to have advantage in toughness and durability over conventional knives where the knife and handle are not formed integrally from one piece of metal.

However, such one-piece knives have, in the past, had several significant disadvantages. From a subjective standpoint, one-piece all-metal knives are sometimes viewed as being of less quality and value as compared to conventional knives. Perhaps the most significant disadvantage was that the metal handle did not provide a comfortable grip for using the knife. An especially economical method of producing one-piece knives involves stamping or forming them from sheet or bar metal stock. In so doing, however, the handle portion of the knife is of the same general thickness as is the blade portion. This can result in the knife handle being of a relatively thin profile, which, without more, can be uncomfortable to use. The knives offer no cushioning for the handle portion since the handle is rigid and integral with the blade. On the other hand, the relatively thin thickness of the handle provides for a low- profile knife with a reduced bulk, as compared to a conventional knife having an enlarged handle fixed to the blade.

Another feature of conventional knives is that the handle is designed for ambidextrous use, i.e., the knife must be usable by either left or right-handed individuals. Also, depending on the respective orientation between the knife handle and the blade, the knife must sometimes be oriented in a particular manner in order to fit in a sheath, depending on the handle design.

To store a knife, sheathes have been designed which will allow the knife to be quickly removed from the sheath when needed. Other sheaths have been designed which provide a strap, elastic loop, or the like, for engaging the handle to retain the knife within the sheath. Still further, knives have been designed which secure the handle of the knife to the blade-receiving portion of the sheath through a mechanical means. For example, U.S. Pat. No. 2,391,574, issued to Housinger on Sep. 30, 1943, discloses a knife handle having a spring arm riveted to the knife blade. The spring arm includes a locking pin which is received in a notch formed in the sheath.

U.S. Pat. No. 4,404,747, issued to Collins, the inventor of the present invention, on Sep. 20, 1983, discloses a knife having a spring-biased button that is receivable in an opening provided in the sheath. The button is depressed when the knife is inserted into the sheath, and remains depressed until reaching the opening, where it then pops into engagement with the opening to lock the knife in the sheath. U.S. Pat. No. 4,856,192, also issued to Collins, on Aug. 15, 1989, discloses a knife having button portions receivable in a hole defined in the sheath. A leaf spring biases one of the button portions into the hole, depending on how the knife is inserted into the sheath. One embodiment of the patent discloses the use of a button and a coil spring, for allowing the knife to be inserted in a locking position into the sheath in only one way. U.S. Pat. No. 4,964,554, again issued to Collins, on Oct. 23, 1990, discloses a knife being retained in a sheath by a bolt and spring, which are slidably contained within a channel within the sheath.

Another knife and sheath design is provided on a knife sold by Dacor (Hi-Tech Hunting Style Knife 7216-00) which includes a button mounted on the sheath for engaging the knife.

In certain situations, it is necessary to have a knife safely secured within a sheath, while at the same time having the knife quickly removable for use. This could be a need for active persons such as rescue workers, backpackers, climbers, and hunters, etc. This is also a particular need of underwater divers. Divers often require the use of their knives in dark, sometime disorienting, environments. Having a simple yet reliable means for quickly releasing the knife from the sheath can be extremely important.

Sheaths are typically provided with a loop portion or open portion for receipt of a belt worn about the waist of the user, or for receipt of a retaining strap. Such an arrangement typically requires for the user to either remove his or her belt in order to place the sheath on the belt, or requires that the strap have a free end available to be inserted through the strap opening.

Sheath-type devices have been disclosed which may be clipped onto an object. For example, U.S. Pat. No. 125,921, issued to Will, et al. on Apr. 23, 1872, discloses a scabbard having a clasp bar and flat spring which pivot about a plate. The clasp bar is moved through action of a screw contacting the plate, the clasp bar being interposed between the back side of the sheath and the head of the screw. U.S. Pat. No. 1,131,669, issued to Bremer, on Mar. 16, 1915, and 4,759,483, issued to Willoughby, on Jul. 26, 1988, disclose other types of sheath attachment means.

While prior sheath attachment configurations are available, they present limitations which often interfere with a low-profile, easy-to-use device.

Although folding knives are often times carried in the pocket of the user, there are occasions when it would be advantageous to be able to clip a folding knife to the user's pocket, belt, strap, boot upper, or the lot. While pocket knives are available which have a clip, such as that of U.S. Pat. No. 4,347,665, issued to Glesser, which discloses a folding knife having a clip, the present invention provides an adjustable clip which can be readily adjusted. This allows the knife to be attached to articles of various thickness and also allows for the gripping pressure of the clip on the article to be varied. Further, the adjustable clip of the present invention provides a low profile securing device less likely to snag or catch on another object, thereby minimizing the risk of inadvertently losing the knife.

It is the principal object of this invention to provide a knife having a blade and handle of integral construction which is comfortable to use.

It is another object of the present invention to provide a knife having a releasable sheath locking structure.

It is another object of the present invention to provide a sheath having means for releasably securing a knife therein.

It is yet another object of the present invention to provide a sheath which can be readily attached to and removed from a belt or other article.

It is another object of the present invention to provide a knife which can be selectively configured for either left-handed or right-handed use.

It is still another object of the present invention to provide a knife which can be simply and economically produced.

It is yet another object of the present invention to provide a folding knife which can be readily attached to and removed from a belt or other article.

It is a further object of the present invention to provide a folding knife having an adjustable clamping device which is of low profile and which can be securely tightened down onto an article.

These and other aspects of the present invention will become further evident upon reference to the following drawings and accompanying specification.

Generally, one preferred embodiment of the present invention includes a knife and sheath combination, the sheath being usable in association with an article. The knife and sheath combination includes a knife having an elongated unitary member defining a blade portion and a handle portion. The handle portion defines a grip receiving opening, and at least one grip member is provided for receipt in the grip receiving opening. At least one flexible elongated tab member movable with respect to the handle portion is provided, the tab member having a first end adjacent the grip member and a second end opposite the first end of the tab member, the second end of the tab member being cantilevered and free to move with respect to the handle portion. A tab projection is connected to the tab member and extends outwardly from the handle portion.

The sheath has a front portion, a back portion opposite the front portion, and first and second side portions opposite one another and each being connected to the front and back portions. The front and back portions and the first and second side portions together define a blade receiving passage. The back portion has a frontal surface adjacent the receiving passage and a rearward surface opposite the frontal surface. The front portion defines a tab projection opening for receiving the tab projection of the tab member of the knife, such that upon the blade portion being inserted into the blade receiving passage, the tab portion projects outwardly from the front portion of the sheath and releasably engages the tab projection opening to retain the knife in the sheath. Accordingly, the knife is removable from the sheath upon depression of the tab projection into the tab projection opening.

Sheath retention means are provided which are connected to the rearward surface of the back portion of the sheath for selectively retaining the sheath to an article.

More specifically, the sheath retention means may include at least one receiver projecting outwardly from the back portion, and a clamping arm having a first end and a second end. The first end of the clamping arm is pivotally connected to the receiver for pivotal movement with respect to the back portion of the sheath, and the second end of the clamping arm includes an engagement portion projecting outwardly from the second end of the clamping arm and towards the rearward surface of the back portion of the sheath.

The first end of the clamping arm includes a threaded bore, which is adjacent the receiver and opposite the second end of said clamping arm. A threaded adjustment member threadingly engages the threaded bore, with the threaded adjustment member having a purchase portion positioned between the first end of the clamping arm and the rearward surface of the sheath's back portion for contacting the rearward surface of the sheath upon selective rotation of the enlarged portion, and for biasing the engagement member towards the rearward surface of the back portion. This causes the engagement member to grip an article for consequently retaining the sheath on the article.

In another embodiment, a clamping device for selectively attaching an elongated handle of a knife to a article is disclosed, which comprises an elongated clamping lever having a first end and a second end opposite the first end. A receiver is provided fixedly attached to the knife handle, and the clamping lever is connected to the receiver adjacent the first end of the clamping lever such that the clamping lever is carried for pivotal movement with respect to the receiver and to the knife handle. The first end of the clamping lever defines a threaded bore therein, and an adjustment member is provided having an elongated threaded portion and an enlarged purchase portion. The enlarged purchase portion has first and second opposing sides and is connected to the elongated threaded portion. The elongated threaded portion is carried in and threadingly engages the threaded bore of the clamping lever such that the enlarged purchase portion is positioned between the first end of the clamping lever and the knife handle. The clamping lever is pivotal between an engagement position, for clamping the knife to the article, and a release position, for allowing removal of the knife from the article.

The enlarged purchase portion is rotatable to a handle contact position for moving the clamping lever to the engagement position, wherein the enlarged purchase portion bears against the knife handle, to a handle clearance position for moving the clamping lever to the release position, wherein the enlarged purchase portion clears the handle of the knife.

A further embodiment includes a receptacle defined in the end of a knife handle for receipt of a rotatable thumbwheel. The thumbwheel threadingly engages with a threaded member fixedly attached to one end of a clamping lever. As the thumbwheel is rotated, the clamping end of the clamping lever can be moved toward or away from the backside of the knife handle for selectively gripping an article. Because of the arcuate movement of the threaded member, the receptacle is configured such that the thumbwheel can be carried therein at a slight angle to accommodate the angle of the threaded member as the clamping lever pivots. A slot is also provided in the handle which communicates with the receptacle such that the threaded member can move unobstructedly in the slot during pivoting of the clamping lever.

BRIEF DESCRIPTION OF THE DRAWINGS

The foregoing, as well as other objects of the present invention, will be further apparent from the following detailed description of the preferred embodiment of the invention, when taken together with the accompanying drawings, in which:

FIG. 3 is a perspective view of a locking knife and sheath combination constructed in accordance with the present invention with the knife retention means being shown in use;

FIG. 4 is a perspective view of a locking knife and sheath combination constructed in accordance with the present invention wherein the sheath attachment means is illustrated in use;

DESCRIPTION OF THE PREFERRED EMBODIMENT

Figure 1:
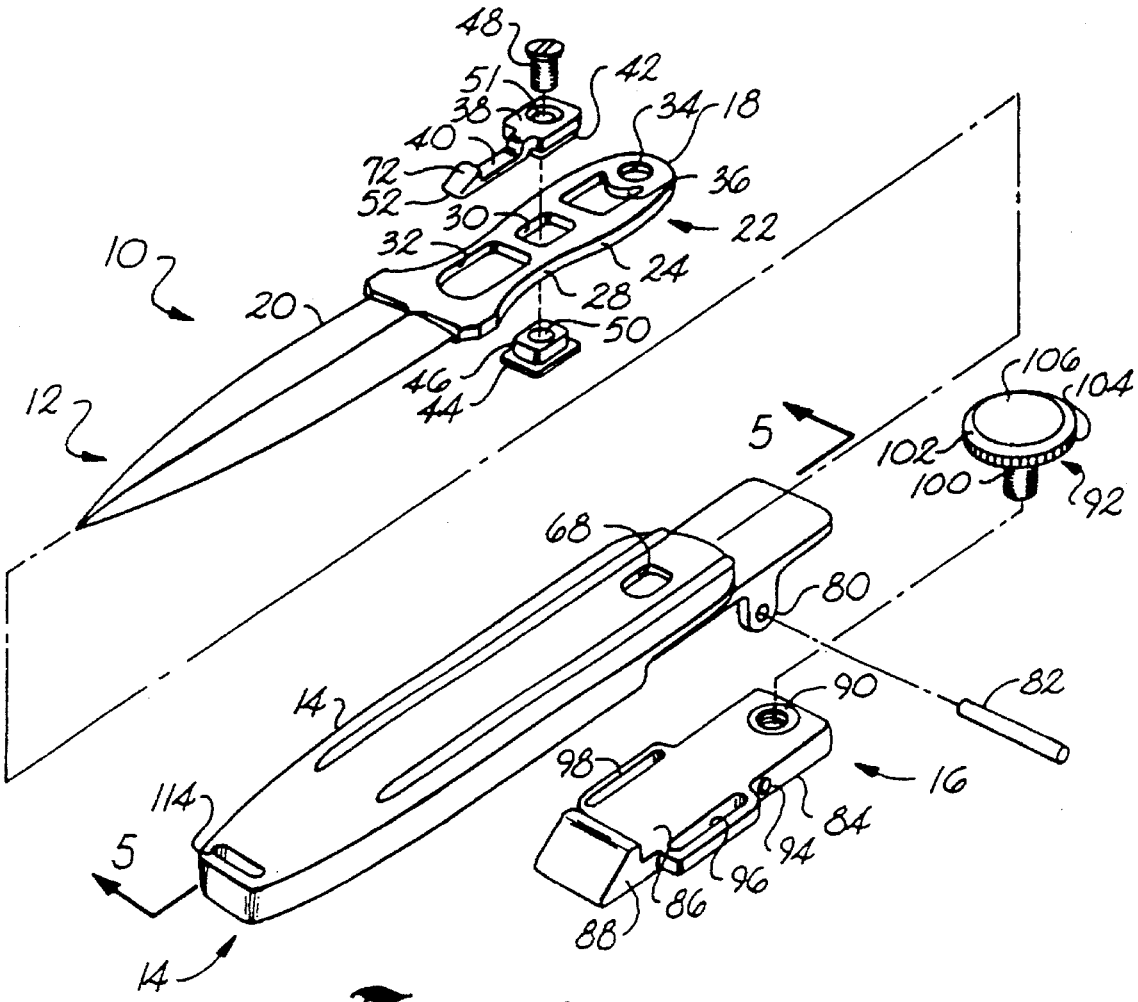
FIG. 1 is an exploded perspective view of a locking knife and sheath combination constructed in accordance with the present invention.

Referring to the drawings in detail, wherein like reference characters represent like elements or features throughout the various views, the locking knife and sheath combination of the present invention is designated generally in the figures by reference character 10.

Referring to FIG. 1 of the drawings, locking knife and sheath combination 10 is illustrated in an exploded view and includes a knife, generally 12, a sheath, generally 14, and sheath retention, or clamping, means, generally 16.

Knife 12 is of unitary construction, with a handle portion 18 and a blade portion 20 being formed on the same piece of material. Knife 12 is preferably constructed of steel, and in particular, of Vasco Max steel, manufactured by Teledyne Allvac/Vasco, of Monroe, N.C., which is of high cobalt content. Alternately, conventional 440 C steel, which is of high carbon content, could be used. It is to be understood, however, that any other suitable cutlery steel or metal could be used instead.

Handle portion 18 defines a grip, generally 22, having a relatively wide portion 24 for being received in the palm of the hand 26 of the user and a tapered-in portion 28 for receipt by the thumb and fingers of the user's hand. Handle portion 18 also defines a grip receiving opening 30 and an elongated tab member receiving opening 32 which will be discussed in more detail below. A utility opening 34 is provided in the end of handle portion 18, through which a lanyard may be placed or for receipt of a nail or peg on which knife 10 may be held. Opening 36 defined in handle portion 18 is for receipt of the meaty portion of the palm of the user's hand, which is adjacent to the thumb, to further stabilize the handle portion 18 within the user's hand during use.

A grip member 38 is provided having an elongated tab member 40 attached thereto. Tab member 40 is preferably molded with grip member 38 to together form one integral piece. Grip member 38 and tab member 40 are preferably constructed of Grivory, sold by American Grilon, Inc., of Sumter, S.C., which is a material with the appearance of ivory. However, any other suitable material, such as wood, plastic, metal, or the like could be used instead. Grip member 38 is generally of a rectangular shape and includes a recessed portion 42 which is received in grip receiving opening 34. A cooperating grip member 44 is provided which is also generally rectangular shaped and includes a recessed portion 46 to be inserted into grip receiving opening 30. Grip members 38, 44 are held within grip receiving opening by means of a screw 48, or other suitable fastener. Cooperating grip member 44 preferably includes a threaded metal bushing 50 molded therein for receipt of screw 48. Grip member 38 includes a smooth bore 51 through which screw 48 passes upon threaded engagement with bushing 50 of cooperating grip member 44.

Tab member 40 is cantileveredly attached to gripping member 38 such that it is readily flexible with respect to handle portion 18 and grip member 38. A ramp-shaped tab projection 52 is provided on the end of tab member 40 opposite where tab member 40 is connected to gripping member 38. Tab member 40 and tab projection 52 are free to move within tab member receiving opening 32, once gripping members 38, 44 are connected together with screw 48. Flexure of tab member 40 within tab member receiving opening 32 is preferably accomplished by the user using his or her finger to depress tab member 40 in a direction as shown by arrow 49 to within opening 32.

Sheath 14 is illustrated in FIGS. 1 through 5, and includes a front portion 54, a back portion 56 opposite front portion 54, and side portions 58, 60 spaced opposite one another, and each being connected to front and back portions, 54, 56. Front and back portions 54, 56 and side portions 58, 60 together form a blade receiving passage 62 in which blade portion 20 of knife 12 is received. Although blade portion 20 is shown in the figures as being double-edged, it is to be understood that blade portion 20 could also have only a single cutting edge, if desired.

Figure 2:
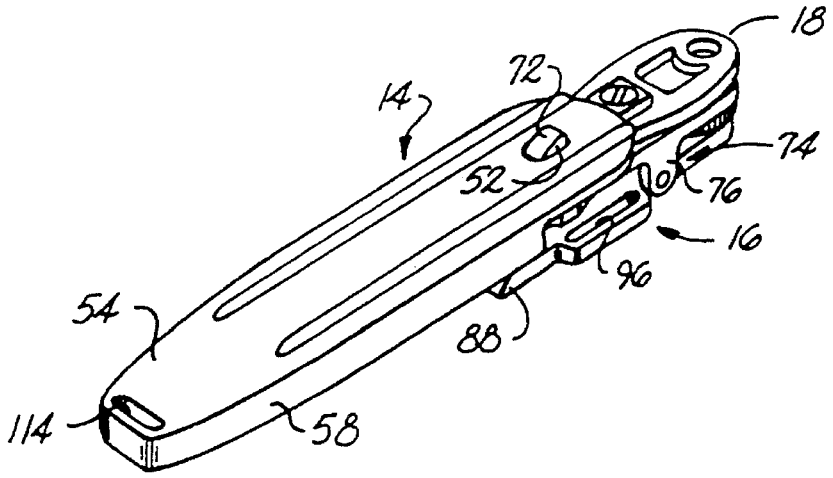
FIG. 2 is a perspective view of a knife and sheath combination constructed in accordance with the present invention.
Figure 5:
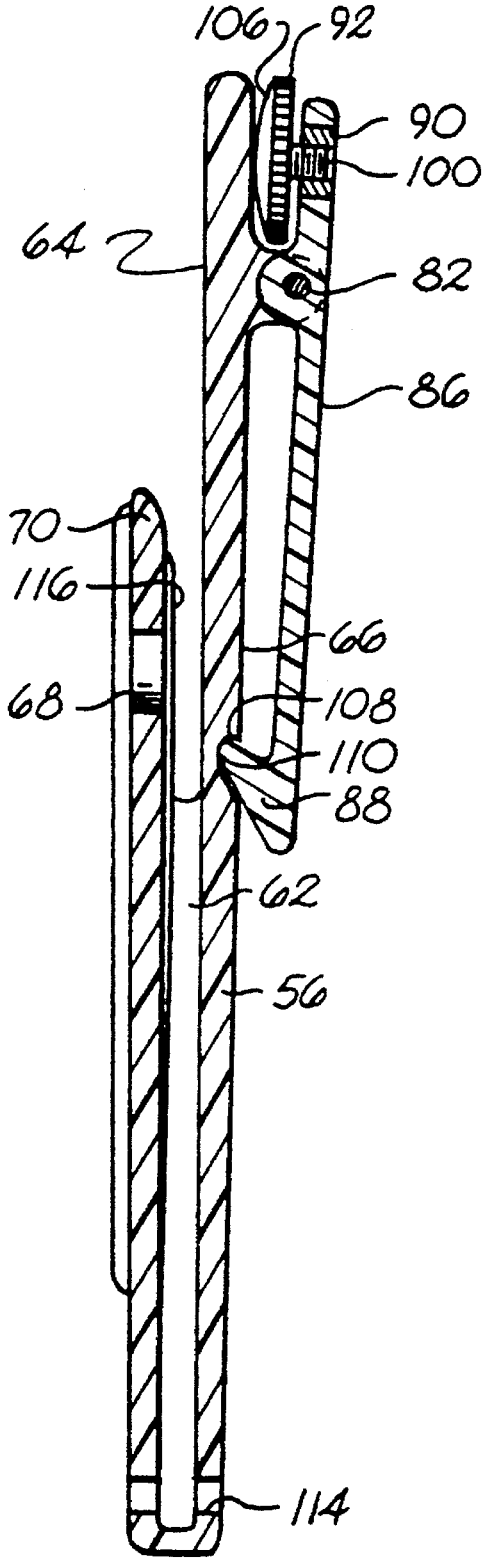
FIG. 5 is a sectional view taken along lines 5—5 of FIG. 1.

Turning to FIG. 5, sheath 14 also includes a frontal surface 64 provided on back portion 56 and a rearward surface 66 also provided on back portion 56, on the opposite side thereof from frontal surface 64. Sheath front portion 54 defines a tab projection opening 68 for receiving tab projection 52 on tab member 40, which is connected to handle portion 18 of knife 12, when knife blade portion 20 is inserted into blade receiving opening 20. An extension portion 70 is provided adjacent tab receiving opening 68 and engages the ramp portion 72 of tab projection 52 upon blade portion 20 being inserted into knife receiving opening 62. In other words, tab projection 52 is automatically depressed by extension portion 70 such that blade 20 may be easily inserted into the sheath. It is only when tab projection 52 reaches tab opening 68 that tab projection 52 springs upwardly within tab projection opening 68. In that position, as illustrated in FIG. 2, tab projection 52 extends outwardly beyond front 26 portion 54 of sheath 14 such that when it is desired to remove knife 12 from sheath 14, the user simply depresses tab projection 52 with his or her finger until projection 52 clears projection opening 68 altogether to allow knife 12 to be removed from sheath 14.

Sheath 14 is preferably constructed of plastic, and in particular of Zytel, a glass-filled nylon, although any other suitable material could be used.

On the opposite side of sheath 14 from tab projection opening 68 is sheath clamping structure 16, which is pivotally connected to a receiver, generally 74, provided on rearward surface 66 of sheath back portion 56. Receiver 74 includes arms 76, 78 extending outwardly from rearward surface 66 and includes bores 80 for receipt of a pin 82. A clamping arm 84 is provided having an elongated portion 86 and an engagement member 88, of a generally ramped-shape. Opposite the end of elongated portion 86 having engagement member 88, a threaded bushing 90 is provided in elongated portion 86 for receipt of a threaded adjustment member, or thumbwheel screw, generally 92. Elongated portion 86 also includes a bore 94 running transversely there through before receipt of pin 82. Further, elongated portion 86 includes slots 96, 98 through which a strap, belt, or like may be passed for retention of sheath 14 thereto.

Thumbwheel screw 92 includes a threaded portion 100 and an enlarged head portion 102 having ridges 104 defined in its circumference. Thumbwheel screw 92 includes a contact surface 106 which bears against rearward surface 66 of the back portion 56 on the sheath when thumbwheel screw 92 is rotated in a counter clockwise direction (as seen facing contact surface 106). Through the bearing of contact surface 106 against rearward surface 66, clamping arm 84 is caused to pivot about pin 82 such that engagement member 88 approaches and engages rearward surface 66 of the sheath. As shown in FIG. 5, a recess, or indentation, 108 may be provided in back portion 56 for receiving engagement member 88. Engagement member also includes a rounded nose portion 110 which seats within recess 108. The rounded surface of nose portion 110 reduces the snagging of engagement member 88 on an article when sheath 14 is removed from the article.

In attaching sheath 14 to the article, such as a belt, boot, backpack, or the like, thumbwheel screw 92 is rotated in a clockwise direction such that engagement member 88 pivots away from sheath back portion 56. This provides for clearance to receive the article, such as a belt 112, which is shown for illustration purposes only, in FIGS. 3 and 4. Sheath 14 is then moved downwardly such that clamping arm 84 extends adjacent one side of belt 112 and sheath back portion 66 extends adjacent the other side of belt 112. Thumbwheel screw 92 is then rotated in a counter-clockwise direction with the user's thumb or forefinger to bring engagement member 88 to bear against belt 112, or, if engagement member 88 clears belt 112, into recess 108. If engagement member 88 does not clear belt 112, and thumbwheel 92 is advanced in a counter-clockwise direction, then belt 112 will be forced slightly into recess 108 such that sheath 14 is securely retained to belt 112.

To release sheath 14 from belt 112, thumbwheel screw 92 is simply rotated in a clockwise direction such that clamping arm 84 pivots away from sheath rearward surface 66, and engagement member 88 clears belt 112 to allow sheath 14 to be lifted upwardly, in a direction as indicated by arrow 113. Accordingly, it can be seen that sheath 14 can be attached to and removed from the user's belt while the user is wearing the belt, without requiring that the user unbuckle and partially remove his or her belt. It can also be seen that the sheath clamping structure 16 can be readily used to clamp sheath 14 to articles other than belts, such as boot uppers, pockets, straps, etc.

Accordingly, sheath 14 can be attached to an article using just one hand, and knife 12 can also be locked into place within sheath 14 and quickly removed from the sheath using just one hand. Sheath 14 also includes at one end a strap-receiving opening 114 for receiving a strap or lanyard, for example, to be used in strapping the lower end of sheath 14 to a user's leg or another object, if desired. Also, openings 96, 98 can be used to attach sheath 14 to a strap in addition to, or in lieu of, use of clamping arm 84 for sheath retention.

As illustrated in FIG. 5, blade receiving passage 62 of sheath 14 preferably includes longitudinally extending ridges 116 (only one being shown) which define guideways for guiding blade portion 20 into blade receiving opening 62.

A significant feature of knife 12 is the ambidextrous nature afforded by gripping members 38, 44 acting in conjunction with handle portion 18. Gripping members 38, 44 may be configured, when blade portion 20 is of a single edge design, to be most comfortable for either left or right-handed use by simply reversing gripping members 38, 44 to opposite sides of handle portion 18. Alternately, if knife 12 is of a double-edge design, with the edges being of different configurations with respect to one another (for example, one edge being straight and the other edge being serrated), the particular desired orientation of the knife within the sheath can be selected by selecting the orientation of gripping members 38,40. Because tab member opening 32 and grip receiving opening 30 extends all the way through handle portion 18, reversal of grip members 38, 44 would not affect the operation of the tab locking feature for retaining knife 12 within sheath 14.

The knife design of the present invention can be manufactured relatively simply. Because the handle portion 18 and blade portion 20 are all one piece, the conventional steps of permanently fixing a separate handle member to the knife tang portion can be minimized. Gripping members 38, 44 are simply attached to handle portion 18 by means of screw 48. Obviously, knife 12 could be used without gripping members 38, 44, if desired.

Figure 6:
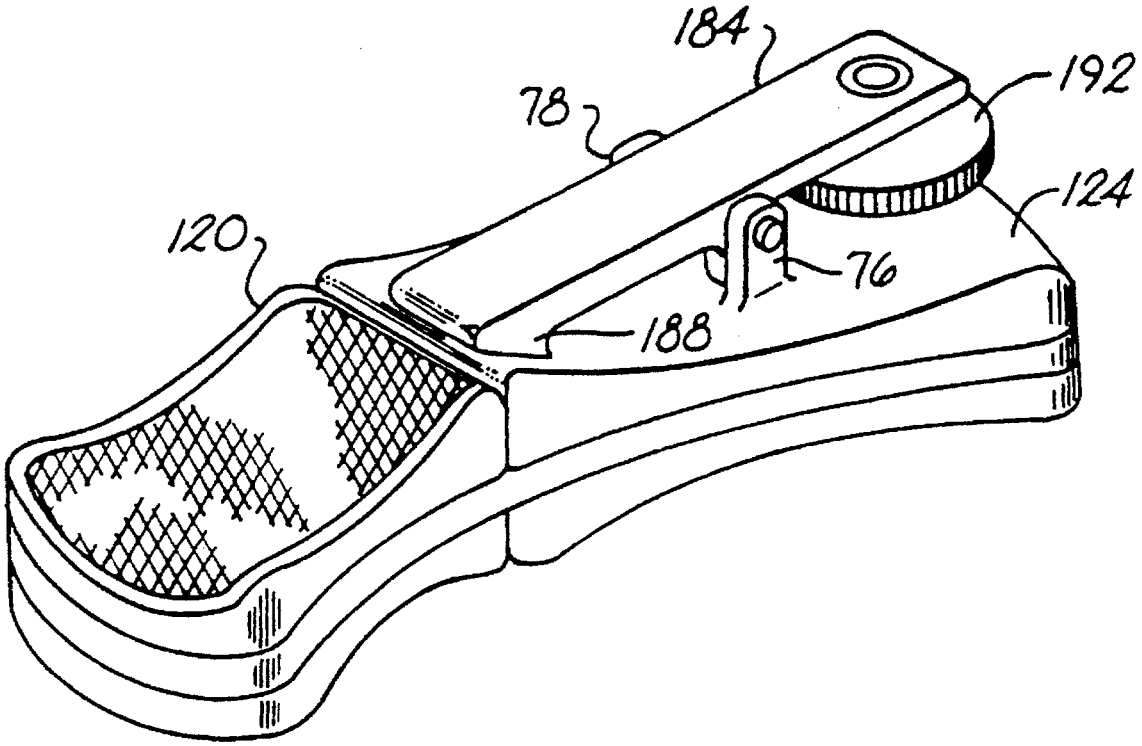
FIG. 6 is a perspective view of an alternate embodiment wherein means are provided for attaching a folding knife to an article.
Figure 7:
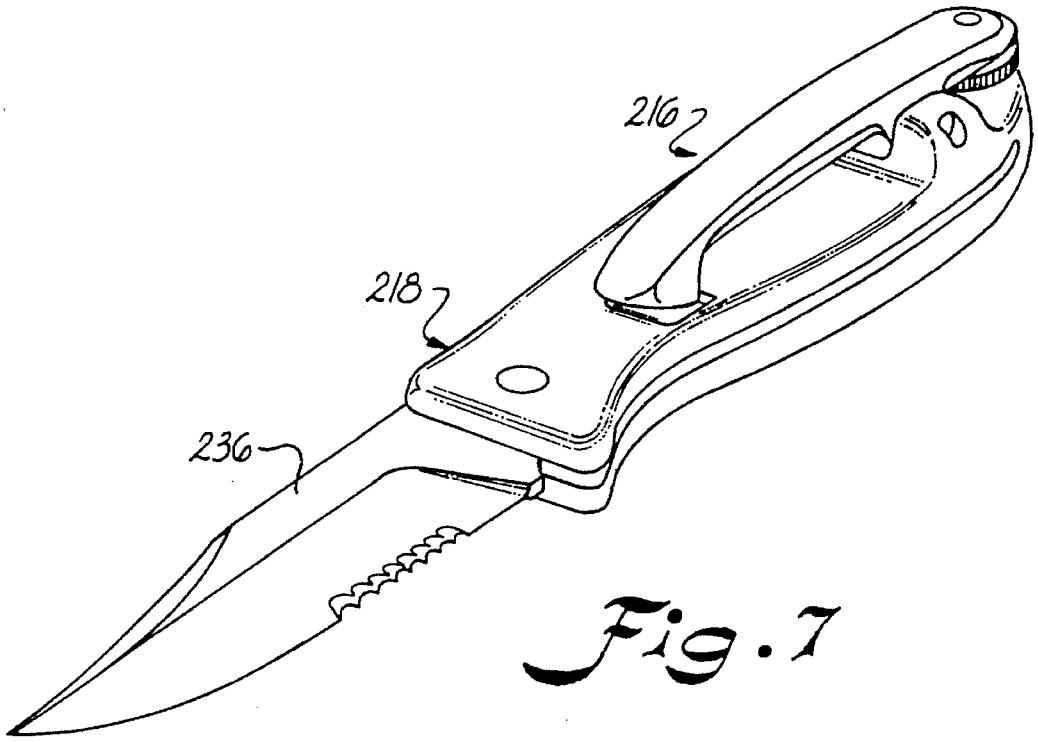
FIG. 7 is a perspective view of a folding knife having a clamping device constructed in accordance with the present invention.
Figure 8:
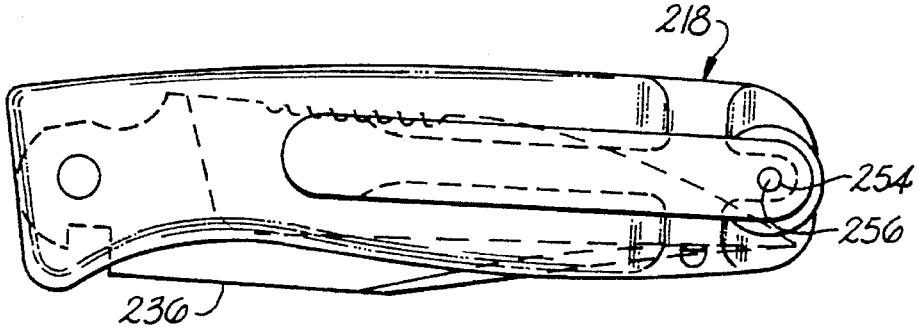
FIG. 8 is a plan view, with portions shown in phantom, of a folding knife having a clamping device constructed in accordance with the present invention.
Figure 9:
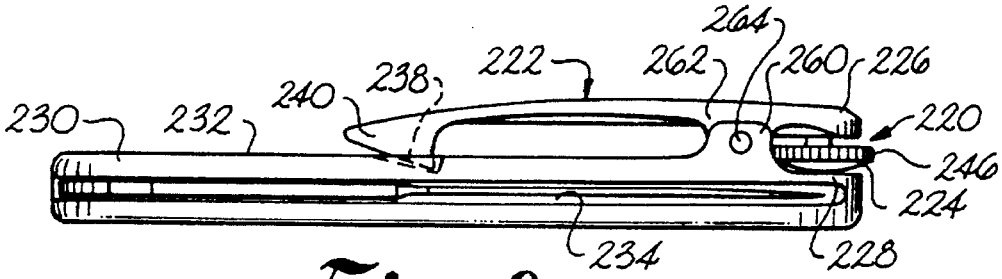
FIG. 9 is a side elevational view of a folding knife having a clamping device constructed in accordance with the present invention.

An alternate embodiment of the sheath clamping structure is illustrated in FIG. 6 as applied to a folding knife 120. Folding knife 120 includes a clamping structure substantially the same as that disclosed above with regards to sheath 14, and includes a clamping arm 184 pivotally carried on receiver arms 76, 78. A thumbwheel screw 192 is threadingly carried in one end of clamping arm 184, and when rotated, bears against an outer surface 124 of pocket knife 120. The bearing of thumbwheel screw 192 against outer surface 124 causes engagement member 188 to move against outer surface 124 for clamping folding knife 120 to an article, a portion of which would be disposed between outer surface 124 and engagement member 188. Accordingly, operation of clamping structure 116 is substantially the same as that discussed above regarding clamping structure 16 used in conjunction with a sheath 14.

In FIGS. 7 through 10, further embodiments of the present invention are shown illustrating a clamping device, generally 216, for use with a folding knife 218. While the operation of the clamping device 216 is substantially the same as that of clamping structure 16, discussed above, it is to be emphasized that the provision of the clamping device 216 to a folding knife allows for attachment of the folding knife to a wide variety of articles, such as belts, pockets, straps, boot uppers, scuba diving gear, etc. in a secure clamping arrangement. By virtue of the thumbscrew threaded member 220, the clamping lever 222 can be tightened down for a strong gripping force against the article to which the knife 218 is attached. Also, the gripping force can be easily varied to a lesser gripping strength, if desired, by adjusting the thumbscrew threaded member 220. Further, because the enlarged portion 224 of the thumbscrew is disposed between a first end 226 of the clamping lever 222 and the first end 228 of the handle 230, the thumbwheel screwhead provides for a low profile, streamlined clamping structure, which thereby reduces the likelihood of the clamping adjustment means 216 inadvertently snagging on other articles of clothing, equipment, or other objects. Also, because the rounded head 224 of the thumbwheel screw 220 is carried between the clamping arm 222 and the backside 232 of the handle 230, it does not project toward nor contact with the user's body, thereby improving the comfort of carrying the knife 218.

The folding knife 218 of FIGS. 7 through 10 includes a blade receiving cavity 234 into which the blade 236 pivots from an extended position to a retracted position. It is to be understood that the knife 218 could be used wherein the blade 236 is maintained in its extended position, and in such configuration, clamped to a belt or other article.

Defined in the backside 232 of the handle is a recess 238 for receiving a downwardly extending tab 242 provided on the second end 242 of the clamping lever 222. The clamping lever 222 is curved throughout its length in a direction towards the backside 232 of the knife in order to improve the comfort of the knife when held in the users hand and also to improve the ease in which the clamping lever 222 can be attached to an article.

The first end 226 of the clamping lever 222 covers a majority of one side of the thumbwheel screwhead 224 and the backside 232 of the handle covers a majority of the other side of the thumbwheel screwhead while leaving the ridged periphery 246 of the thumbwheel exposed for easy contact, or purchase, by the user.

Figure 10:
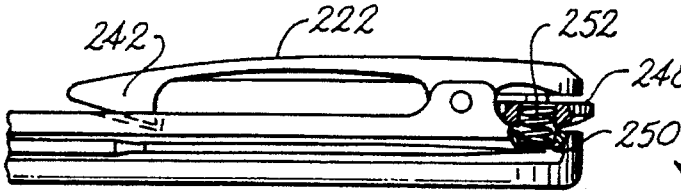
FIG. 10 is a side elevational view, with parts cut away, of an alternate embodiment of a clamping device constructed in accordance of the present invention for use with a folding knife.

In another embodiment, shown in FIG. 10, the thumbwheel head 224 of the screw may include a biasing member chamber 248, and the backside of the handle may also include a cooperating biasing member chamber 250 which receives a biasing member, such as a coil spring 252, therein. By providing the coil spring 252 in the biasing member chambers 248,250, the clamping lever 222 is continuously urged towards its engagement position, for receiving an article, even when the thumbwheel screw 220 is rotated such that it moves away from the backside 232 of the handle 230. The spring force provided the coil spring 252 minimizes any play in the clamping lever when the thumbscrew member is rotated out of contact with the backside of the handle.

Further, the threaded bore 254 provided in the first end 226 of the clamping lever can be closed, such that the elongated threaded portion 256 of the adjustment member 220 will not extend outwardly through the other side of the clamping arm 222, thereby reducing the risk of the clamping device snagging on other articles.

A receiver 260 is provided for receipt of downwardly extending legs 262 of clamping lever 222. A pin 264 connects clamping lever 222 to receiver 260 for pivotal movement.

Figure 11:
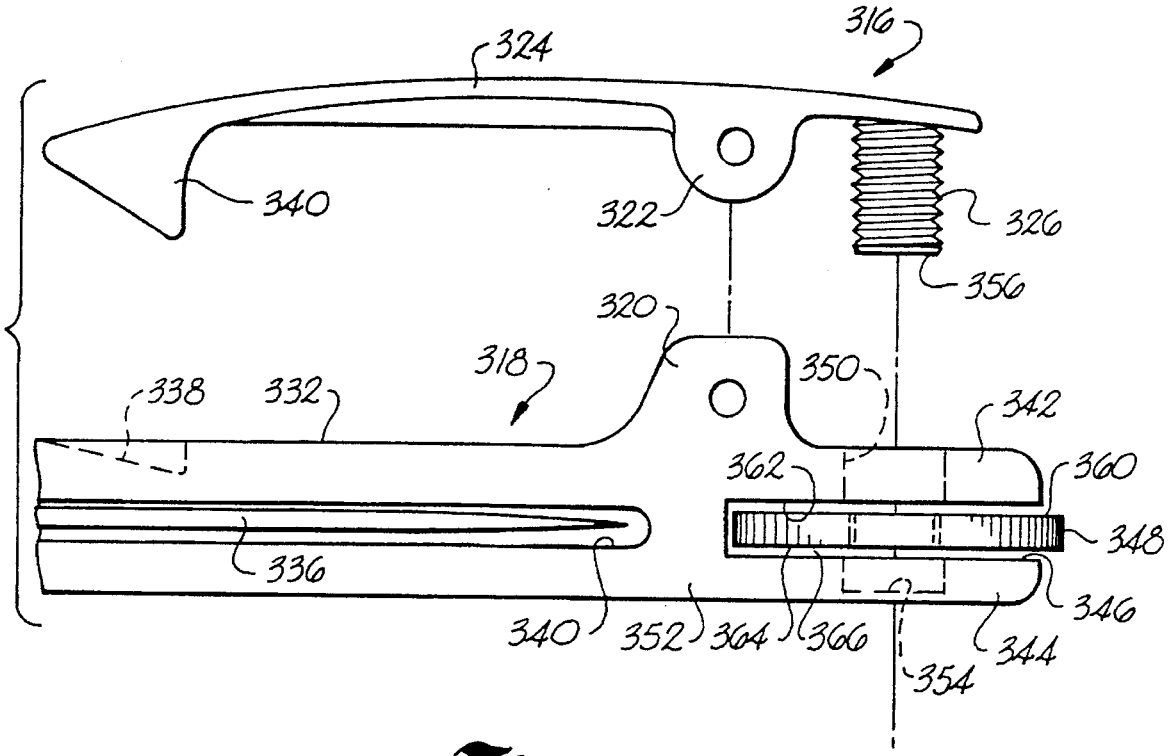
FIG. 11 is a side elevational view, with parts cut away, illustrating a still further alternate embodiment of the present invention.

A still further embodiment of the present invention is illustrated in FIG. 11. FIG. 11 includes a clamping device, generally 316, which is attached to one end of a folding knife 318 (only the end portion of the knife being shown in the drawing).

The knife 318 includes a receiver, generally 320, such as that discussed above. Also downwardly extending legs 322 are provided on clamping arm 324 which cooperate with a pin (not shown) for allowing pivotal movement of clamping arm 324 with respect to the backside 332 of knife 318. Clamping lever 324 includes a downwardly extending engagement tab 340 such similar to that discussed above. Opposite downwardly extending tab 340, clamping lever 324 includes a downwardly extending threaded member 326 which is fixedly attached to clamping lever 324 adjacent legs 322.

The backside 332 of knife 318 is also provided with a recess 338 for receipt of downwardly extending tab 340 to enhance engagement of the clamping device 316 with an article. A conventional folding blade 336 is carried within a blade receiving chamber 340 of knife 318.

Disposed between opposite sides 342 and 344 of knife 318 is a receptacle, generally 346, in which a thumbwheel 348 is carried for rotation. Thumbwheel 348 includes ridged portions at the periphery thereof to improve the gripping, or purchase, thereof during rotation of the thumbwheel 348 by the user. A slot 350 is provided in side 342 of knife handle 352 through which threaded member 326 projects. Slot 350 is large enough to allow slight angular movement of threaded member 326 therein during pivotal movement of clamping lever 324.

A recess 354 is provided in side 344 of handle 352 for receiving the free end 356 of threaded member 326 when threaded member 326 is threadingly engaged by thumbwheel 348.

In operation, thumbwheel 348 threadingly receives threaded member 326. When it is desired to pivot clamping lever 324 to an article engagement position, wherein tab 340 is urged toward recess 338, thumbwheel 348 is rotated to force threaded member 326 upwardly in a direction away from side 342 of handle 352. In so doing, threaded member 326 will become angled slightly with respect to handle 352, due to the arcuate movement of clamping lever 324. This in turn will cause a slight canting, or angling, of thumbwheel 348 such that an upper surface 360 of thumbwheel 348 engages a first side 362 of receptacle 346, and a lower surface 364, correspondingly engages a second side 366 of receptacle 346. This angling of thumbwheel 348 during use ensures that the threaded member is fixedly secured with respect to knife handle 352, which correspondingly causes a tight engagement of tab 340 with respect to the backside 332 of knife handle 352, while the angled binding of thumbwheel 348 in receptacle 346 causes clamping device 316 to be tight and substantially rattle-free. To move clamping lever 324 to a release position, thumbwheel 348 is simply rotated in the opposite direction.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art, without departing from the spirit or scope of the following claims.

What is claimed is:

1. A clamping device for selectively attaching an elongated knife handle of a knife to an article, comprising:

an elongated clamping lever having a first end and a second end opposite said first end;

a receiver fixedly attached to the elongated knife handle, said clamping lever being pivotally connected to said receiver adjacent said first end of said clamping lever such that said clamping lever is carried for pivotal movement with respect to said receiver and to said knife handle;

said first end of said clamping lever defining a threaded bore therein;

an adjustment member having an elongated threaded portion and an enlarged purchase portion, said enlarged purchase portion having first and second opposing sides and being connected to said elongated threaded portion;

said elongated threaded portion being carried in and threadingly engaging said threaded bore of said clamping lever such that said enlarged purchase portion is positioned between said first end of said clamping lever and the knife handle;

said clamping lever being pivotal between an engagement position, for clamping the knife to the article, and a release position, for allowing removal of the knife from the article; and said enlarged purchase portion being rotatable to a handle contact position for moving said clamping lever to said engagement position, wherein said enlarged purchase portion bears against the elongated knife handle, and to a handle clearance position for moving said clamping lever to said release position, wherein said enlarged purchase portion clears the elongated knife handle.

2. A clamping device as defined in claim 1, wherein said adjustment member is a thumbwheel screw, and wherein said enlarged purchase portion of said adjustment member forms the thumbwheel portion of said thumbwheel screw.

3. A clamping device as defined in claim 1 wherein the knife handle includes a folding knife attached thereto.

4. A clamping device as defined in claim 1, further comprising an engagement portion fixedly attached to said second end of said clamping lever and projecting downwardly from said second end of said clamping lever towards the knife handle.

5. A clamping device as defined in claim 4, further comprising a recess defined in the knife handle for receiving said engagement portion of said clamping lever when said clamping lever is in said engagement position.

6. A clamping device as defined in claim 1, wherein said clamping lever is curved along the length thereof in a direction towards the knife handle.

7. A clamping device as defined in claim 1 wherein said first opposing side of said enlarged purchase portion defines a rounded engagement surface for contacting and bearing against the knife handle.

8. A clamping device as defined in claim 1, wherein said enlarged purchase portion defines a first biasing member chamber and a second biasing member chamber is defined in the knife handle, adjacent to said first bearing member chamber defined in said enlarged purchase portion; and further comprising a biasing member carried in both said first and second biasing member chambers for biasing said clamping lever toward said engagement position.

9. A clamping device as defined in claim 8, wherein said biasing member is a coil spring.

10. A clamping device as defined in claim 1, further comprising said first end of said clamping lever covering a substantial portion of said enlarged purchase portion.

11. A clamping device as defined in claim 1, wherein said first and second opposing sides of said enlarged purchase portion are substantially covered by the handle of the knife and said first end of said clamping lever, respectively.

12. A clamping device as defined in claim 1, wherein said threaded bore of said clamping lever is closed opposite said elongated threaded portion of said adjustment member.

13. A clamping device as defined in claim 1, wherein said clamping lever extends over at least half of the length of the knife handle.

14. A folding knife, comprising:

an elongated knife handle having a first end and a second end opposite said first end, and a first side and a second side opposite said first side; said knife handle defining a blade receiving chamber therein;

at least one blade pivotally attached to said handle and movable between an extended position extending outwardly from said blade receiving chamber and a retracted position wherein said at least one blade is substantially within said blade receiving chamber;

an elongated clamping lever having a first end and a second end opposite said first end;

a receiver fixedly attached to said first side of said handle; said clamping lever being pivotally connected to said receiver adjacent said first end of said clamping lever such that said clamping lever is carried for pivotal movement with respect to said receiver and to said handle;

said first end of said clamping lever defining a threaded bore therein;

an adjustment member having an elongated threaded portion and an enlarged purchase portion, said enlarged purchase portion having first and second opposing sides and being connected to said elongated threaded portion; said elongated threaded portion being carried in and threadingly engaging said threaded bore of said clamping lever such that said enlarged purchase portion is positioned between said first end of said clamping lever and said first end of said handle;

said clamping lever being pivotable between an engagement position, for clamping the knife to an article, and a release position, for allowing removal of the knife from the article; and said enlarged purchase portion being rotatable to a handle contact position for moving said clamping lever to said engagement position, wherein said enlarged purchase portion bears against said first side of said handle, and to a handle clearance position for moving said clamping lever to said release position, wherein said enlarged purchase portion clears said first side of said handle.

15. A folding knife as defined in claim 14, further comprising an engagement portion fixedly attached to said second end of said clamping lever and projecting downwardly from said second end of said clamping lever towards said first side of said handle; and said first side of said handle defining a recess for receiving said engagement portion of said clamping lever when said clamping lever is in said engagement position.

16. A folding knife as defined in claim 14, wherein said enlarged purchase portion defines a first biasing member chamber and said first side of said handle defines a second bearing member adjacent to said first bearing member chamber; and further comprising a biasing member carried in both said first and second biasing member chambers for biasing said clamping lever towards said engagement position.

17. A folding knife, comprising:

an elongated handle having a first end and a second end opposite said first end, and a first side and a second side opposite said first side; said knife handle defining a blade receiving chamber therein;

at least one blade pivotally attached to said handle and moveable between an extended position extending outwardly from said blade receiving chamber and a retracted position wherein said at least one blade is substantially within said blade receiving chamber, an elongated clamping lever having a first end and a second end opposite said first end;

a receiver fixedly attached to said first side of said handle; said clamping lever being pivotally connected to said receiver adjacent said first end of said clamping lever such that said clamping lever is carried for pivotal movement with respect to said receiver and to said handle;

said first end of said clamping lever including a threaded member fixedly attached thereto;

an adjustment member having an enlarged purchase portion, said enlarged purchase portion having first and second opposing sides, said enlarged purchase portion being threadingly engageable with said threaded member; said elongated handle defining a receptacle between said first and second sides of said handle, said receptacle defining a slot for receipt of said threaded member;

said clamping lever being pivotable between an engagement position, for clamping the knife to an article, and a release position, for allowing removal of the knife from the article; and said enlarged purchase portion being rotatable to a first position for causing said threaded member to move said clamping lever to said engagement position and to a second position for causing said threaded member to move said clamping lever to said release position.

18. A folding knife as defined in claim 17, wherein said first and second opposing sides of said enlarged purchase portion are substantially covered by said first and second sides, respectively, of said elongated handle.

* * * * *